United States Patent [19]

Miller

[11] Patent Number: 4,693,473

[45] Date of Patent: Sep. 15, 1987

[54] GOLF BALL RETRIEVER

[76] Inventor: Eldon E. Miller, 126 Meadow La., Solon, Ohio 44139

[21] Appl. No.: 796,893

[22] Filed: Nov. 12, 1985

[51] Int. Cl.[4] ..... A63B 57/00

[52] U.S. Cl. ..... 273/32 F; 294/19.2; 273/162 E

[58] Field of Search ..... 273/162 E, 33, 32 F, 273/32 B; 294/19.1, 86.13, 19.2, 86.27, 86.3, 86.31, 99 S, 100, 106, 110 A, 129, 130

[56] References Cited

U.S. PATENT DOCUMENTS

| | | | |
|---|---|---|---|
| 1,452,679 | 4/1923 | Fisher | 294/19.2 |
| 1,658,145 | 2/1928 | Uyei . | |
| 1,696,817 | 12/1928 | John | 294/19.2 |
| 2,116,651 | 5/1938 | Ackerson . | |
| 2,834,629 | 5/1958 | Williams | 294/19.1 |
| 3,547,314 | 12/1970 | Brandell . | |
| 3,669,427 | 6/1972 | Curtis | 294/19.1 |
| 3,922,027 | 11/1975 | Nesselt | 294/19.1 |
| 4,013,295 | 3/1977 | Baughman | 273/162 E |
| 4,466,650 | 5/1958 | Roedel | 294/19.1 |

*Primary Examiner*—Richard C. Pinkham
*Assistant Examiner*—T. Brown
*Attorney, Agent, or Firm*—Watts, Hoffmann, Fisher & Heinke Co.

[57] ABSTRACT

A ball retriever preferably for retrieving golf balls from a water hazard. The disclosed retriever includes a stationary support mounted at the end of a handle which can be of a telescoping design to extend the retriever a considerable distance into the hazard. The stationary support pivotally mounts two capturing arms which are continuously biased towards each other with a spring. A trigger mechanism having a cup-shaped end element contacts a target golf ball and releases a latching member, freeing the two capturing arms for movement in response to the biasing spring. This biasing action encloses the capturing arms about the target golf ball so that it can be withdrawn from the water hazard.

7 Claims, 4 Drawing Figures

GOLF BALL RETRIEVER

TECHNICAL FIELD

The present invention relates to a ball retriever particularly suited for retrieving errant golf balls from a water hazard.

BACKGROUND ART

The popularity of golf has lead to the development of many accessory items useful in playing the game. One accessory item particularly useful on courses including water hazards is the golf ball retriever. For those familiar with the game a description of this device is not needed, for the uninitiated, however, a golf ball retriever is a device for retrieving a golf ball which has strayed from its intended course to the bottom of a water hazard.

Prior art devices used for retrieving golf balls typically include an elongated, telescoping handle which in a retracted position is conveniently stored within the golfer's golf bag. At the end of the handle a cuplike member that typically pivots is used for engaging and securing the golf ball. Once the golf ball is safely within the confines of the cup-like member, the user withdraws the retriever from the hazard and secures the ball.

Use of the prior art golf ball retrievers has always been a tricky business. It is often difficult to secure the ball within the cup-like member at the end of the handle. In maneuvering the retriever it often contacts the bottom of the hazard and the water becomes so muddy that the ball is temporarily lost from sight. In a fast moving stream where the current rapidly clears the water, the user can often secure the ball on subsequent efforts. In a stagnant pond or slow moving stream, however, the muddy condition can last far longer than the average golfer will devote for golf ball retriving.

Attempts have been made to reduce the difficulty of retrieving a submerged golf ball. Prior art U.S. Pat. Nos. 3,669,427 to Curtis, 2,834,629 to Williams, and 4,013,295 to Baughman disclose apparatus for capturing a submerged ball within the confines of a pivoting arm rather than a cup-like member. Each of these patents discloses a resilient biasing member which in one position biases the arms in an open condition and in response to contact with a golf ball, biases the arms into a closed position.

Applicant knows of no commercialization of the devices embodied in these patents and for this reason believes that a problem may exist in the trigger mechanism of these devices. They depend for their operation on a rather precise equilibrium position of the pivoting point of the capturing arms. Stated another way, the devices employ two equilibrium positions, one where the spring biases the arms in an open position, and a second where the spring biases the arms closed to capture a submerged golf ball. This condition may result in uneven or uncontrolled opening and closing of the arms at inopprotune times during the retrieval process. Since the user's own state of equilibrium is often in doubt due to an uneven stream bank, or the necessity to closely approach the shore, the structure of these patents may have resulted in inopportune and unintended opening and closing.

DISCLOSURE OF THE INVENTION

A golf ball retriever constructed in accordance with the invention includes ball capturing arms mounted at the end of an elongated handle that are affirmatively biased toward a closed position at all times. The device includes a trigger mechanism that selectively releases the arms. The invention does not rely upon two positions of stable equilibrium, one to bias the arms in an open position and a second to close the arms about the ball. Instead, the user must arm the mechanism prior to its use.

In one embodiment of the invention, the ball retriever includes a support adapted for mounting at one end of the handle which may, for example, be telescoping to fit within a golf bag. The support is fixed with respect to the handle and defines an angle of approach between the handle and a ball to be retrieved. Two arms are pivotally mounted to the support and move between an open and a closed position. In the closed position, the configuration of the arms is such that the ball is trapped between these pivoting arms. A resilient biasing mechanism continuously biases the arms toward the closed position.

A trigger mechanism mounted to the support includes a contact member that engages the ball as the user maneuvers the retriever. A latching member that holds the arms in the open position releases the arms in response to movement of the contact member allowing the biasing mechanism to close the arms about the ball.

The ball retreiver has two states of equilibrium, one is an open position with the arms biased toward the closed position but wherein movement is inhibited by the latching mechanism. A second equilibrium position is in the closed position where the arms entrap or capture the golf ball. Use of a latching mechanism which must be affirmatively armed by the user prior to use of the retriever results in reliable, consistant, and efficient operation of the retriever.

Experience with the present retriever indicates that when the handle is fully extended or telescoped to its longest extent, it may be difficult to apply sufficient pressure on the ball trigger to release the latching member. This is not viewed as a defect in the mechanism, rather a indication that the points of stable equilibrium are secure and help avoid inappropriate or unintended closure of the pivoting arms. In this fully extended position, however, one can simply oscillate the handle up and down and the whip action of the handle combined with the inertia of the trigger causes the latching mechanism to release, thereby engaging and capturing a target golf ball.

The present preferred material for the retriever capturing mechanism is metal. In high volume production of the device it is anticipated, however, that the support, arms, and trigger mechanism will be made from plastic.

From the above is should be appreciated that one object of the invention is a reliable mechanism for retrieving golf balls. This and other objects, advantages and features of the invention will become better understood when a detailed description of a preferred embodiment of the invention is described in conjunction with the accompanying drawings.

BEST MODE FOR CARRYING OUT THE INVENTION

Figure 1:
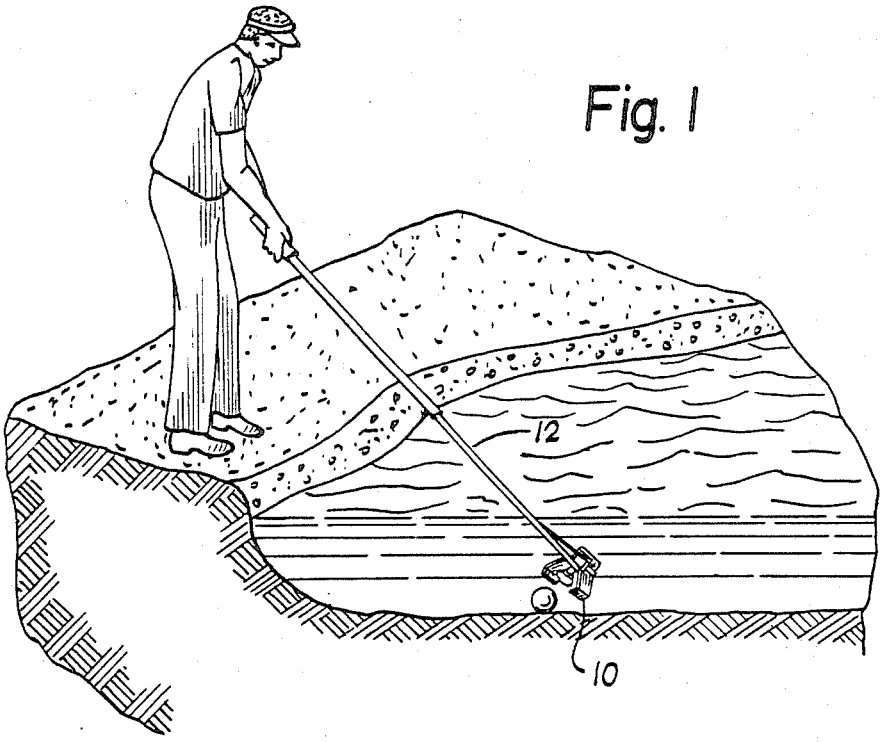
FIG. 1 is a perspective view showing a golfer retrieving a ball with a retreiver constructed in accordance with the invention.

Turning now to the drawings, FIG. 1 shows a new and improved golf ball retriever 10 constructed in accordance with the invention. The retriever is coupled to a handle 12 that can be a conventional telescoping handle that allows the golfer to extend his or her reach a sufficient amount to trap and withdraw a golf ball lying on the bottom of a water hazard.

Figure 4:
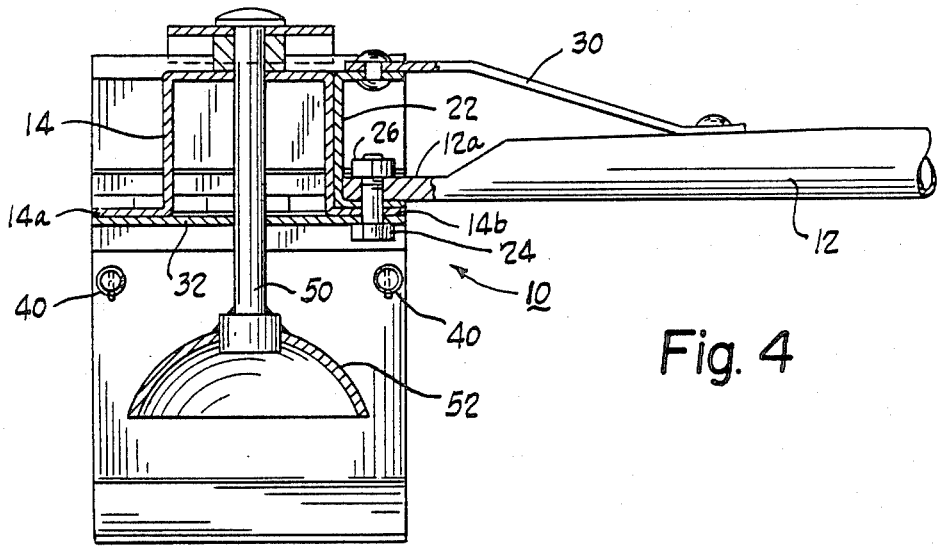
FIG. 4 is a partially sectional view of the retriever seen along the line 4—4 in FIG. 2.

The retriever 10 includes an immobile or fixed support 14 (FIG. 2) on which are mounted capturing arms 16, 18 and a trigger mechanism 20. The support 14 is a generally U-shaped member having flanges **14*a*, 14*b* (FIG. 4) extending at right angles to the angle of capture defined by the support 14. A mounting bracket 22 is connected to the support 14 by bonding, brazing or welding. A threaded connecter 24 which in a preferred embodiment is a threaded bolt and coacting nut 26 secures the support 14 and the mounting bracket 22 to a flatened portion 12a of the handle 12. The bracket member 22 is also U-shaped in section and in combination with a strut 30 rivited to the bracket 22 and handle 12, stabilizes the support 14 in relation to the handle 12**.

Figure 3:
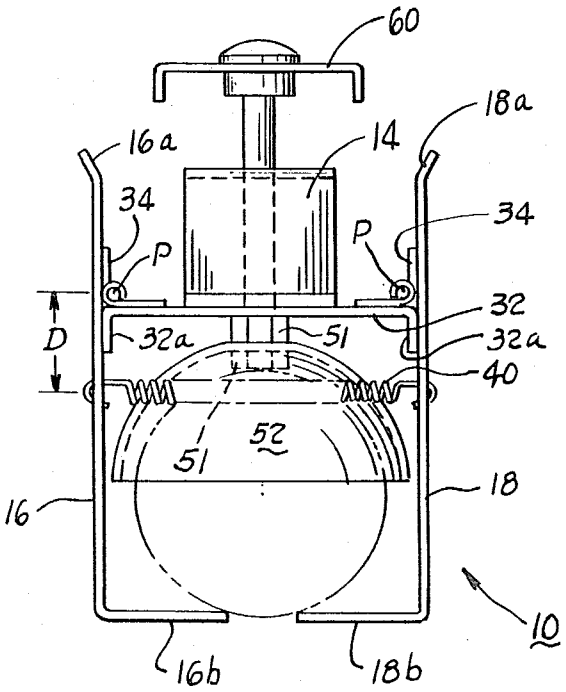
FIG. 3 is an elevation view of the retriever apparatus showing the retriving arms closed about a target golf ball.
Figure 2:
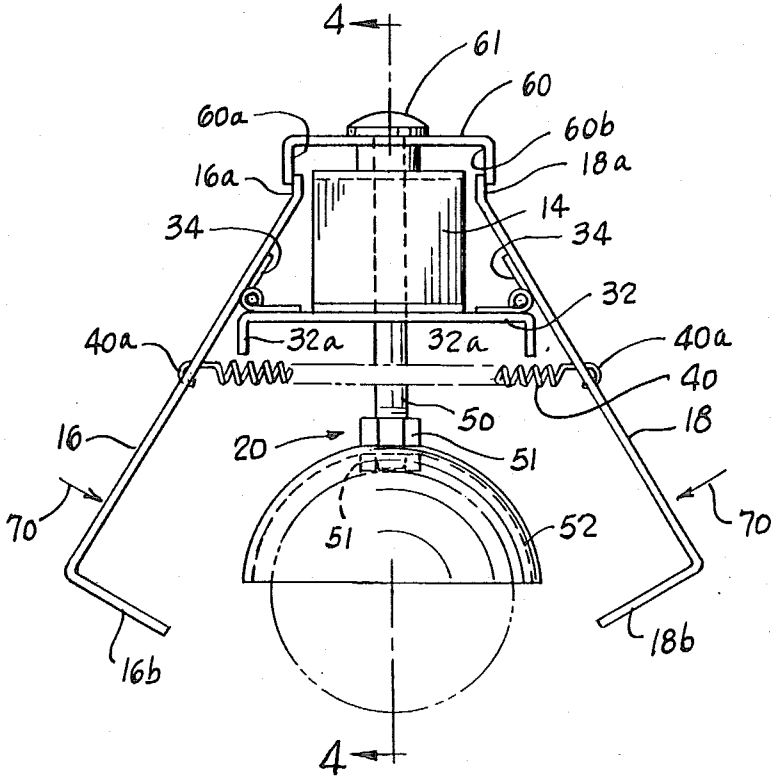
FIG. 2 is an elevation view of the retriever apparatus showing the capturing arms in an open position.

A support bottom bracket 32 connected (by welding or the like) to the support 14 carries the two arms 16, 18. The bottom bracket 32 is coupled to the arms 16, 18 via four hinges 34, only two of which are seen in FIGS. 2 and 3. These hinges are preferably welded to the arms 16, 18 and support bracket 32 but riveting or other suitable mechanism for attachment can be used. The hinges 34 pivotally mount the arms 16, 18 with respect to the stationary support 14 and bracket 32.

The two arms 16, 18 are biased toward each other by two springs 40 stretched between the arms 16, 18. The springs 40 continuously bias the arm members to a closed position. At each end of the spring 40 a hook **40*a*** passes through an aperture in the arm and engages an outer surface of the arm to bias the arm to the closed configuration.

The trigger 20 includes a threaded rod 50 passing through holes or apertures in the mounting bracket 32 and support 14. At a bottom end of the threaded rod 50, the rod 50 supports a cup shaped member 52 configured to engage a target golf ball as a user manipulates and orients the retriever 10 relative the ball. The cup shaped member 52 has an aperture extending through a flattened portion of its surface to receive the rod 50. Connectors 51 secure the cup shaped member 52 in place at the bottom of the rod 50.

At an opposite end of the rod 50 to a latching member 60 is supported for up and down movement in response to forces applied through the rod 50 from the cup-shaped trigger member 52. The latching member 60 is held in place by a threaded fastener 61 that engages the rod 50. The latching member 60 is also of a U-shaped configuration having inner surfaces **60*a*, 60*b* that face each other and serve as retaining surfaces for the inwardly biased arms 16, 18**.

In the position shown in FIG. 2, the inwardly facing latch surfaces **60*a*, 60*b* engage end most portions 16*a*, 18*a* of the two arms. The end portions 16*a*, 18*a* are angled with respect to an intermediate section of the arms so that when movement of the arms is restrained by the latch 60, the arms are sufficiently spread apart to enable the trigger member 52** to come in contact with a target golf ball.

At a bottom end of the two arms 16, 18 those arms define capturing portions **16*b*, 18*b*. The capturing portions 16*b*, 18*b* are bent at generally right angles to the intermediate portion of the arm members. In the open position of FIG. 2 the springs 40 continuously bias the arms 16, 18 to a closed position indicated by the arrows 70 in FIG. 2**.

FIG. 3 illustrates the retriever 10 with a ball captured within the cup shaped trigger member 52 and the capturing arm portions **16*b*, 18*b*. In this configuration the springs 40 have not been completely restored to an unstretched configuration so that the arms 16, 18 are still biased toward each other. Stops 32*a* formed in the bottom bracket 32 limit the extent of arm movement under biasing action of the springs 40. The stops 32*a* extend away from a bottom surface of the bracket at substantially right angles and at this angle the arms 16, 18 never contact the cup shaped trigger member 52**.

The operation of the ball retriever 10 will now be discussed in conjunction with the FIG. 2 and 3 depictions of the invention. The retriever 10 is armed by the user prior to a retrival effort. This is accomplished by the user manually opening the arms 16, 18 against the biasing action of the springs 40. Once the arms have been sufficiently opened, the bracket 60 is pushed downward until the facing surfaces **60*a*, 60*b* engage the end most arm sections 16*a*, 18*a*. The relationship between the pivot point P defined by the hinges 34 and the position along the arms 16, 18 where the springs engage those arms insure that the arm portions 16*a*, 18*a* are biased outwardly against the inner surfaces 60*a*, 60*b* and that the frictional engagement between the arms 16, 18 and bracket 60 are sufficient to maintain the retriever in the configuration shown in FIG. 2**.

Once the user has armed the retriever 10 it is inserted into the water and maneuvered until the golf ball of interest is properly positioned in relation to the trigger 20. This stage of capture is illustrated in FIG. 1. To capture the golf ball, the user moves the retriever 10 until the target golf ball contacts the cup shaped trigger member 52. Continued downward pressure applied by the user through the handle 12 causes the contact between golf ball and the trigger member 52 to exert an upward force to the latching member 60 through the threaded rod 50. This upward force overcomes the frictional engagement between latching member 60 and arms 16, 18 and releases the arms from the FIG. 2 position, allowing them to snap closed under biasing action of the springs 40. The angled bottom portion of the arms **16*b*, 18*b* in combination with the cup-like trigger member 52 surround and entrap the target golf ball as illustrated in FIG. 3. To release the golf ball after it has been withdrawn from the bottom of the water hazard, the user merely spreads the two biased arms 16, 18** apart and the captured ball is released.

In an alternate mode of operation, in those circumstances which the arm 12 is fully extended, the pressure between target golf ball and trigger member 52 may not be sufficient to release the latching member 60. In those circumstances, experience with the disclosed retriever 10 indicates that capture can be accomplished by oscillating the handle 12 up and down so that the inertia of the trigger member 52, rod 50 and latching member 60 produces relative movement between the latching member 60 and the arms 16, 18. If the target golf ball is in close proximity to the trigger member 52 as this oscillation occurs, when the arms are released it will be captured within the confines of the retriever 10.

The construction and arrangement of the capturing arms 16, 18, hinges 34 and spring biasing members 40 insure positive engagement between the arms and the golf ball once the latching mechanism 60 releases the arms. As seen in FIG. 3, the torque exerted by the two stretched springs 40 about the pivot points P defined by the hinges 34 is related to the distance D between the pivot point P and the point of engagement between the arms 16, 18 and the springs 40. As the spring closes the arms the movement arm D lengthens slightly as the force of retraction lessens. In all configurations, however, the arms 16, 18 are affirmatively biased toward each other.

The present invention has been illustrated in an embodiment constructed from metal parts preferably stamped sheet metal. It is contemplated, however, that in production manufacturing of the disclosed retriever 10, these components will be constructed from molded plastic members. Thus, although the invention has been described with a degree of particularity, it is the intent that the invention include all modifications and/or alterations from the disclosed embodiment falling within the spirit or scope of the appended claims.

I claim:

1. A ball retriever comprising:

an elongated handle;

ball capturing means mounted at one end of the handle, said ball capturing means including a rigid support fixed with respect to the handle, first and second arms, each of said first and second arms comprising a planar member pivotally coupled to the rigid support and movable between an open and a closed position, each planar member including a ball capturing portion angled at one end with respect to a support engaging portion to close about a ball in said closed position and angled at an opposite end of the support engaging portion to define a latch engaging portion;

resilient biasing means to continuously bias said arms to a closed position; and trigger means mounted to the ball capturing means for movement with respect to the ball capturing means, said trigger means including a contoured member for contacting the ball and a latching member for engaging the latch engaging portion of said arms to hold said arms in an open position, said contoured member rigidly connected to said latching member so that movement of the trigger means releases the latch engaging portion of said arms from the latching member causing said resilient biasing means to close said arms about said ball and secure said ball within the contoured trigger member and said arms.

2. The ball retriever of claim 1 where the biasing means comprises two springs coupled to said first and second arms between the ball engaging portion and a pivot point of each arm.

3. The ball retriever of claim 1 where the first and second arms are mounted to the rigid support by hinge members and the rigid support defines a mechanical stop to limit the extent of arm pivoting in the direction of the closed position.

4. A golf ball retriever comprising:

an elongated handle for positioning a ball retrieving end of said retriever relative a target ball;

ball capturing means mounted at the ball retrieving end of the handle, including a rigid support fixed with respect to the handle and first and second arms pivotally coupled to the rigid support and movable between an open and a closed position, each of said arms including a planar ball capturing portion at one end to close about a ball in said closed position, a planar support engaging portion angled with respect to the ball capturing portion for mounting said arm to the rigid support, and a planar latch engaging portion angled with respect to said support engaging portion for holding said arm in an open position;

spring biasing means to continuously bias said capturing portion of said arms toward each other to a closed position; and trigger means mounted to the ball capturing means for movement with respect to the ball capturing means and including a contoured member for contacting the ball and a latching member for engaging the latch engaging portion of the arms to hold said arms in an open position, said contoured member rigidly connected to said latching member so that movement of the trigger means releases said arms from the latching means allowing said resilient biasing means to close said arms about said ball and secure said ball within the contoured trigger member and the ball capturing portion of said arms.

5. Ball retriever apparatus comprising:

support means for mounting at one end of an elongated handle;

first and second ball capturing arms pivotally coupled to the support means and movable between an open and a closed position, each of said first and second ball capturing arms comprising a generally planar member bent at one end to define a ball enclosing portion, bent at an opposite end to define a latch engaging portion, and defining an elongated midportion pivotally connected to the support means;

resilient biasing means to continuously bias said arms to a closed position; and trigger means mounted to the support means, including a contact member for contacting the ball and a latch member engaging said latch engaging portions for holding said arms in an open position, said contact member rigidly connected to said latch member so that movement of the trigger means releases said latch engaging portion from the latch member allowing said resilient biasing means to close said first and second ball capturing arms about said ball and secure said ball between the contact member and the first and second ball capturing arms.

6. The ball retriever of claim 5 where the trigger means comprises a cup-shaped contact member connected to a rod member passing through the support means and the latching member comprises a U-shaped member including inwardly facing surfaces that frictionally engage the latch engaging portion of said arms.

7. The ball retriever of claim 6 where the arms are connected to the support means by hinges coupled to the elongated midportion of said arms.

* * * * *